US005927251A

United States Patent [19]

Watanabe et al.

[11] Patent Number: 5,927,251

[45] Date of Patent: Jul. 27, 1999

[54] DRIVING CONTROL APPARATUS FOR ENGINE OF VEHICLE

[75] Inventors: Shinji Watanabe; Tadashi Tubakiji, both of Tokyo, Japan

[73] Assignee: Mitsubishi Denki Kabushiki Kaisha, Tokyo, Japan

[21] Appl. No.: 09/025,785

[22] Filed: Feb. 19, 1998

[30] Foreign Application Priority Data

Nov. 11, 1997 [JP] Japan ..... 9-308845

[51] Int. Cl.[6] ..... F02D 7/00

[52] U.S. Cl. ..... 123/399

[58] Field of Search ..... 123/399; 701/114

[56] References Cited

U.S. PATENT DOCUMENTS

| | | | |
|---|---|---|---|
| 5,309,361 | 5/1994 | Drott et al. | 123/399 |
| 5,339,782 | 8/1994 | Golzer et al. . | |
| 5,366,424 | 11/1994 | Wataya | 123/399 |
| 5,447,133 | 9/1995 | Kamio et al. | 123/399 |
| 5,575,255 | 11/1996 | Abe et al. | 123/336 |
| 5,578,749 | 11/1996 | Migaki | 73/118.1 |

FOREIGN PATENT DOCUMENTS 5-202793 8/1993 Japan .

*Primary Examiner*—John Kwon

*Attorney, Agent, or Firm*—Sughrue, Mion, Zinn, Macpeak & Seas, PLLC

[57] ABSTRACT

A driving control apparatus for an engine of a vehicle comprises a first control unit 21 for calculating an engine control parameter, a second control unit 22 for calculating a throttle control amount, and first and second communication lines L1 and L2 for transmitting data between the first and the second control units. The second control unit includes an instrument for judging an abnormality of the first communication line L1. The first control unit includes an instrument for judging an abnormality of the second communication line L2, and second control unit monitor for monitoring an operation of the second control unit based on a first throttle opening degree signal T1 when an abnormality of each of the communication lines is judged. With the above arrangement, an abnormality of the second control unit can be judged at the side of the first control unit with a simple logic, and a reliable driving property can be secured at low costs.

12 Claims, 9 Drawing Sheets

DRIVING CONTROL APPARATUS FOR ENGINE OF VEHICLE

BACKGROUND OF THE INVENTION

1. Field of the Invention

The present invention relates to a driving control apparatus for an engine of a vehicle in which a mutual communication is conducted between a first control unit for calculating an engine parameter and a second control unit for driving a throttle and a redundant sensor is used with respect to a throttle opening degree and an accelerator opening degree, and more particularly, to a driving control apparatus for an engine of a vehicle which is capable of judging an abnormality of the second control unit when the communication between the control units is abnormal.

2. Description of the Related Art

There is a conventionally known driving control apparatus for an engine of a vehicle comprising a first control unit for calculating control parameters with respect to the engine in accordance with its driving state including the accelerator opening degree and the throttle opening degree, a second control unit for calculating a control amount of a throttle actuator in accordance with a target throttle opening degree included in the control parameters, and redundant sensors corresponding to the respective control units.

FIG. 9 is a block diagram showing such a conventional driving control apparatus for the engine of the vehicle as described in Japanese Patent Application Laid-open No. 5-202793 for example.

In FIG. 9, an engine 1 mounted in the vehicle comprises a cylinder and a piston connected to a crankshaft (not shown), and also comprises an intake pipe 2 and an exhaust pipe 3 which are in communication with a combustion chamber in the cylinder, and a spark plug 4 disposed in the combustion chamber.

Provided in the intake pipe 2 are an injector 5 for injecting a fuel, and a throttle valve 6 for adjusting an air amount to be drawn into the engine 1.

Provided in the throttle valve 6 are a throttle actuator 7 including a motor for driving the throttle valve 6, and a throttle position sensor (which will be referred to as TPS hereinafter) 8 for detecting a position of the throttle valve 6 as a throttle opening degree.

The TPS 8 includes first and second throttle position sensor portions (which will be referred to as first and second TPS portions hereinafter) 8*a* and 8*b* for outputting first and second throttle opening degree signals T1 and T2 which are mutually redundant.

An accelerator pedal 9 which is to be depressed by a driver is provided with an accelerator pedal position sensor (which will be referred to as APS hereinafter) 10 for detecting a position of the accelerator pedal 9 as an accelerator opening degree.

The accelerator pedal position sensor 10 includes first and second accelerator pedal position sensor portions (which will be referred to as first and second APS portions hereinafter) 10*a* and 10*b* for outputting first and second accelerator opening degree signals A1 and A2 which are mutually redundant.

Not only the illustrated TPS 8 and APS 10, but also known drawn air amount sensor, crank angle sensor, water temperature sensor and the like are of course included as various sensors for detecting the driving states of the engine 1, although they are not illustrated for simplification.

A first control unit 11 comprising a microcomputer calculates a control parameter with respect to the engine 1 in accordance with driving states (various sensed information) including the accelerator opening degree and the throttle opening degree.

Although a spark signal P with respect to the spark plug 4 and an injection signal J with respect to the injector 5 are indicated here as typical control parameters, other parameters such as a target throttle opening degree with respect to the throttle valve 6 are also calculated.

A second control unit 12 comprising a microcomputer calculates a control amount with respect to the throttle actuator 7 in accordance with the target throttle opening degree calculated in the first control unit 11, and outputs the result as a motor driving signal M.

A first communication line L1 for transmitting data from the first control unit 11 to the second control unit 12, and a second communication line L2 for transmitting data from the second control unit 12 to the first control unit 11 are provided between the first and the second control unit 11 and 12 as buses for conducting a mutual communication.

In this case, the first accelerator opening degree signal A1 and the first throttle opening degree signal T1 are input to the first control unit, and are input to the second control unit 12 through the first communication line L1.

Further, the second accelerator opening degree signal A2 and the second throttle opening degree signal T2 are input to the second control unit 12, and are input to the first control unit 11 through the second communication line L2.

Each of the control units 11 and 12 compares the accelerator 7 opening degree signals A1 and A2, and judges whether or not there exists abnormality of the APS 10 based on the comparison results (agree or disagree) made by the control units 11 and 12.

Similarly, each of the control units 11 and 12 compares the throttle opening degree signals T1 and T2, and judges whether or not there exists abnormality of the TPS 8 based on the comparison results (agree or disagree) made by the control units 11 and 12.

The conventional apparatus constructed as described above judges whether or not there exists an abnormality of the redundant sensors (TPS 8 and APS 10) connected to the control units 11 and 12, and when the apparatus judges that there exists any abnormality, the apparatus carries out appropriate management, e.g., by reducing the target throttle opening degree to suppress the engine output, or by replacing a sensor which is determined as being abnormal.

However, the conventional apparatus does not judge an abnormality in operation of the second control unit 12 for driving the throttle, and no attention is paid as to what management should be carried out when the second control unit 12 is determined as being abnormal.

Therefore, even when sensors are in normal condition, if the throttle valve 6 is fully opened due to an abnormality of the second control unit 12, there is fear that the vehicle may run recklessly.

As described above, although the conventional driving control apparatus for an engine of a vehicle judges an abnormality of the TPS 8 and APS 10 connected to the control units 11 and 12, the apparatus does not judge an abnormality of operation of the second control unit 12. Therefore, there is a problem that a running performance of the vehicle may be deteriorated due to an abnormality in operation at the side of the second control unit 12, even if sensors are in normal condition.

SUMMARY OF THE INVENTION

The present invention has been accomplished to overcome the above described problems, and it is an object of the invention to provide a driving control apparatus for an engine of a vehicle in which an abnormality of the second control unit is judged at the side of the first control unit using a simple logic based on whether or not there exists an abnormality in mutual communication between the control units having redundant structures, thereby securing a reliable running performance of the vehicle at low costs.

Further, it is another object of the invention to provide a driving control apparatus for an engine of a vehicle in which when an abnormality is generated in mutual communication, the engine output is suppressed, and when an abnormality is generated in the second control unit, a power source of a motor of a throttle actuator is cut off and the throttle opening degree is returned and fixed at a fully closed position or an intermediate position, so that the vehicle can run cautiously by controlling a drawn air amount through a bypass valve or the intermediate opening degree.

A driving control apparatus for an engine of a vehicle according to the present invention comprises: an engine mounted in a vehicle; a throttle valve for adjusting an air amount to be drawn into the engine; a throttle actuator including a motor for driving the throttle valve; an accelerator position sensor for detecting a position of an accelerator pedal as an accelerator opening degree; a throttle position sensor for detecting a position of the throttle valve as a throttle opening degree; a first control unit for calculating a control parameter with respect to the engine in accordance with a driving state including the accelerator opening degree and the throttle opening degree; a second control unit for calculating a control amount of the throttle actuator in accordance with a target throttle opening degree which is included in the control parameter; a first communication line for transmitting data from the first control unit to the second control unit; and a second communication line for transmitting data from the second control unit to the first control unit; wherein the accelerator position sensor includes first and second accelerator position sensor portions for respectively outputting first and second accelerator opening degree signals which are redundant with each other; the throttle position sensor includes first and second throttle position sensor portions for respectively outputting first and second throttle opening degree signals which are redundant with each other; the first accelerator opening degree signal and the first throttle opening degree signal are input to the first control unit; the second accelerator opening degree signal and the second throttle opening degree signal are input to the second control unit; the second control unit includes first communication abnormality judging means for judging an abnormality of the first communication line; the result of judgement of the abnormality of the first communication line is sent to the first control unit through the second communication line; and the first control unit includes: second communication abnormality judging means for judging an abnormality of the second communication line; and second control unit monitoring means for monitoring an operation of the second control unit based on at least the first throttle opening degree signal when an abnormality is judged in the first or second communication line.

When an abnormality of the first communication line is judged, the second control unit calculates the control amount of the throttle actuator based on the second accelerator opening degree signal.

When an abnormality of the first communication line is judged, the second control unit calculates the control amount of the throttle actuator based on a value obtained by suppressing the second accelerator opening degree by a predetermined coefficient.

When an abnormality of the second communication line is judged, the first control unit calculates the target throttle opening degree based on a value obtained by suppressing the first accelerator opening degree signal by a predetermined coefficient, and sends the target throttle opening degree to the second control unit through the first communication line.

When an abnormality of the first communication line is judged, the second control unit monitoring means monitors an operation of the second control unit based on a comparison of the first throttle opening degree signal with the first accelerator opening degree signal.

When an abnormality of the first communication line is judged, the second control unit monitoring means compares the first throttle opening degree signal with a value obtained by multiplying the first accelerator opening degree signal by the predetermined coefficient; and when a state in which a difference between the first throttle opening degree signal and the value obtained by multiplying the first accelerator opening degree signal by the predetermined coefficient is equal to or greater than a predetermined value continues for a predetermined time period, the second control unit monitoring means judges an abnormality in operation of the second control unit.

When an abnormality of the second communication line is judged, the second control unit monitoring means monitors an operation of the second control unit based on comparison of the first throttle opening degree signal with the target throttle opening degree.

When an abnormality of the second communication line, the second control unit monitoring means judges an abnormality in operation of the second control unit, if a state in which a difference between the first throttle opening degree signal and the target throttle opening degree is equal to or greater than a predetermined value continues for a predetermined time period.

The driving control apparatus further includes throttle electric power source cutting-off means; wherein when an abnormality in operation of the second control unit is judged, the throttle electric power source cutting-off means cuts off a supply of electric power source to the throttle actuator, and a driving state of the engine is switched to a temporary-driving mode.

The driving control apparatus further includes a bypass passage for bypassing the throttle valve; and a bypass valve for adjusting a bypass drawn air amount flowing through the bypass passage; wherein at the time of the temporary-driving mode of the engine, the throttle valve is fully closed by cutting off the supply of electric power source to the throttle actuator, and the first control unit calculates a control amount of the bypass valve.

At the time of the temporary-driving mode of the engine, the throttle valve is fixed to an intermediate position which is biased toward its opening direction from its fully closed position.

The temporary-driving mode of the engine is maintained until a key switch of the vehicle is turned OFF.

The above and other objects, features and advantages of the invention will become apparent from the following description of the preferred embodiments taken in conjunction with the accompanying drawings.

DETAILED DESCRIPTION OF THE PREFERRED EMBODIMENTS

First Embodiment

A first embodiment of the present invention will be described with reference to FIG. 1.

Figure 1:
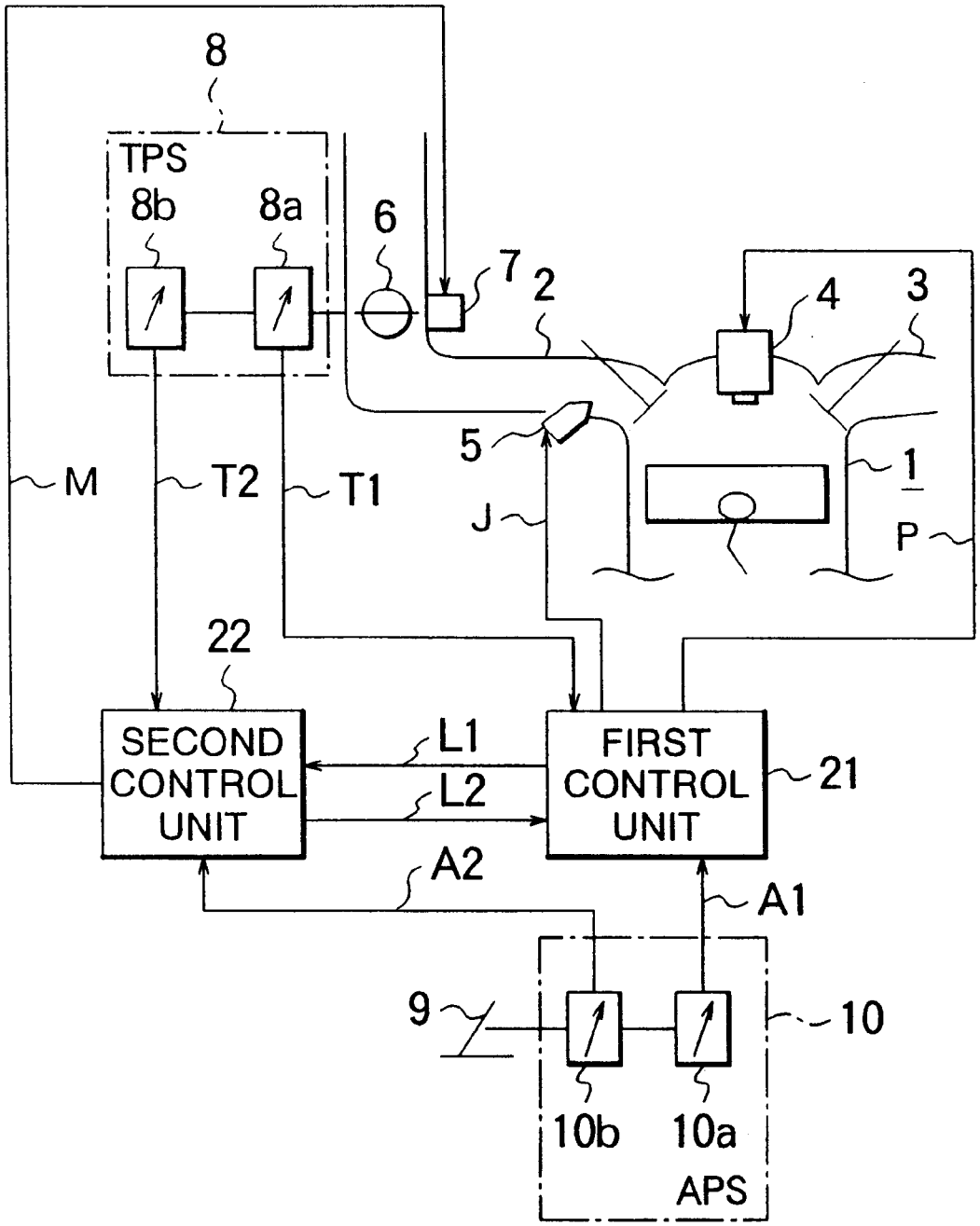
FIG. 1 is a block diagram for showing a first embodiment of the present invention.

FIG.1 is a block diagram showing the first embodiment of the invention, and elements which are similar to those described above are designated with similar reference numbers, and their detailed explanations will be omitted. Control units 21 and 22 correspond to the above-mentioned control units 11 and 12, respectively.

In this case, a first communication line L1 sends, to a second control unit 22, various abnormality judgement results in a first control unit 21 and the like together with a target throttle opening degree To and a first throttle opening degree signal T1.

A second communication line L2 sends, to the first control unit 21, various abnormality judgement results and the like in a second control unit 22 together with a second accelerator opening degree signal A2.

For example, the second control unit 21 includes first communication abnormality judging means for judging a data abnormality of the first communication line L1, and sends an abnormality judgement result of the first communication line L1 to the first control unit 21 through the second communication line L2.

Because the second control unit 22 can not obtain the target throttle opening degree To when an abnormality of the first communication line L1 is judged, the second control unit 22 uses a second accelerator opening degree signal A2 as a substitutive data, and calculates a control amount of a throttle actuator 7 based on the second accelerator opening degree signal A2. At that time, the second control unit 22 also produces a motor driving signal M based on a value obtained by multiplying the second accelerator opening degree signal A2 by a predetermined coefficient k (<1).

The first control unit 21 includes second communication abnormality judging means for judging a data abnormality of the second communication line L2, and second control unit monitoring means for monitoring an operation of the second control unit 22 based on at least the first throttle opening degree signal T1 when an abnormality of the communication line L1 or L2 is judged.

When an abnormality of the second communication line L2 is judged, the first control unit 21 can not obtain the second accelerator opening degree signal A2 from the side of the second control unit 22. Therefore, the first control unit 21 calculates the target throttle opening degree To based on the first accelerator opening degree signal A1, and sends the result to the second control unit 22 through the first communication line L1. Further, at that time, the first control unit 21 calculates the target throttle opening degree To based on a value obtained by multiplying the first accelerator opening degree signal A1 by the predetermined coefficient k (<1).

In this manner, when the communication line L1 or L2 is in an abnormal condition, the throttle opening degree is suppressed in a direction to suppress the engine output based on a value obtained by limiting the accelerator opening degree signal A1 or A2 from the APS 10.

An abnormality of each of the communication lines L1 and L2 in the control units 21 and 22 is judged by a known sum total checking process.

The second control unit monitoring means which is disposed in the first control unit 21 and which functions when a communication abnormality is generated compares the first throttle opening degree signal T1 with a value obtained by multiplying the first accelerator opening degree signal A1 by k, when an abnormality of the first communication line L1 is judged. And if a state in which the difference between the two is equal to or greater than a predetermined value E1 continues for a predetermined time period, a determination is made that the operation of the second control unit 22 is in abnormal.

When the second communication line L2 is judged as being in abnormal, the second control unit monitoring means compares the first throttle opening degree signal T1 with the target throttle opening degree To. And if a state in which the difference between the two is greater than a predetermined value E2 continues for a predetermined time period, a determination is made that the operation of the second control unit 22 is in abnormal.

Next, an operation of the first embodiment of the present invention will be explained concretely with reference to the flowcharts in FIGS. 2 to 4.

Figure 2:
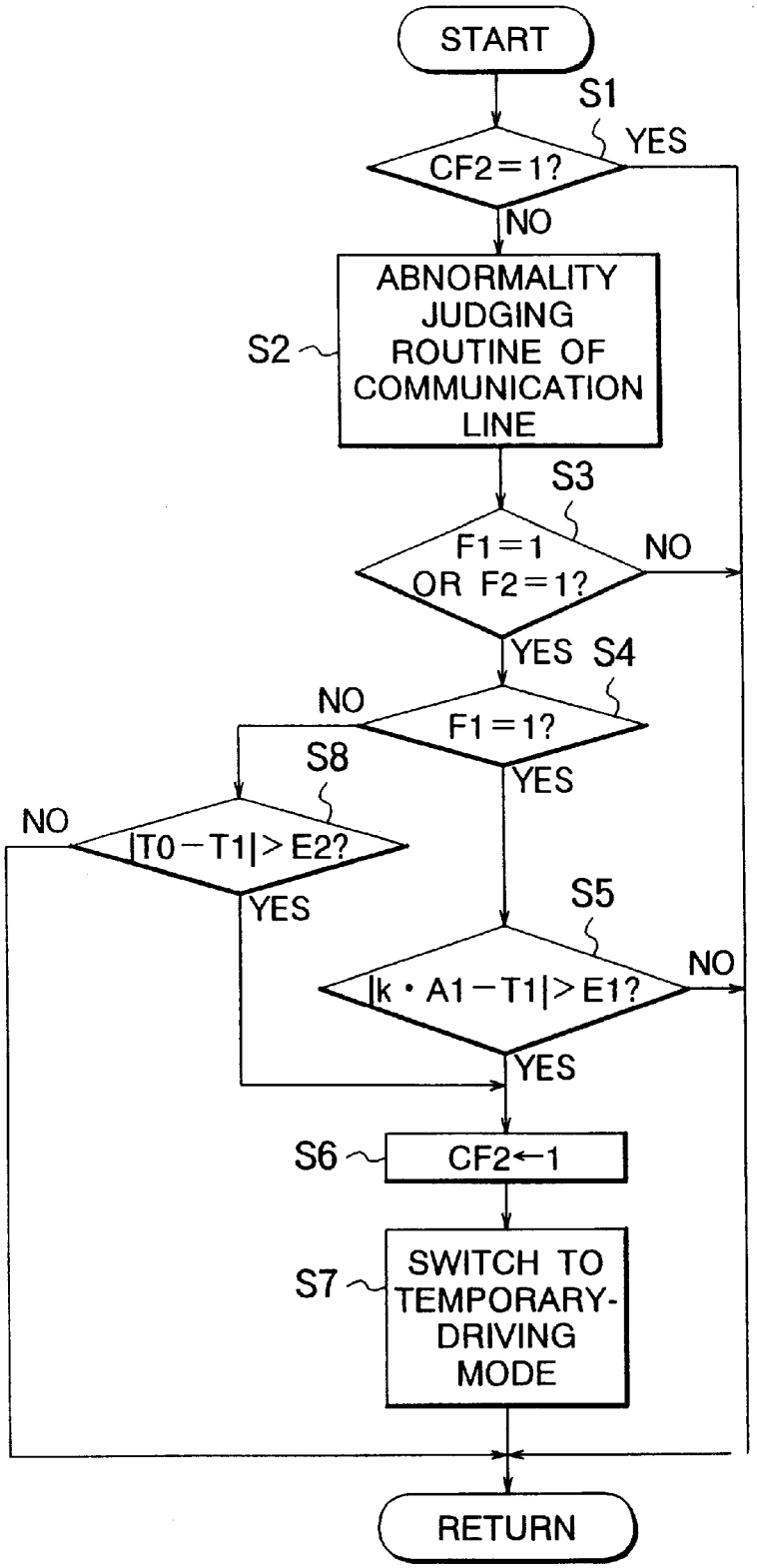
FIG. 2 is a flowchart showing an abnormality judging operation and an operation for management at the time of abnormal condition according to the first embodiment of the invention.

FIG. 2 shows the entire abnormality judging routine and processing routine when an abnormality is judged, by each of the control units 21 and 22. FIG. 3 shows a processing routine by the first communication abnormality judging means at the side of the second control unit 22. FIG. 4 shows a processing routine by the second communication abnormality judging means at the side of the first control unit 21.

Although it is not illustrated in FIG. 2, it is supposed that each of an abnormality judging flag CF2 of the second control unit 22, an abnormality judging flag F1 of the first communication line L1 and an abnormality judging flag F2 of the second communication line L2 is cleared to "0" when the engine is initially started (when a key switch is turned on).

After the engine is started, each of the control units 21 and 22 first refers to the abnormality judging flag CF2 of the second control unit 22, and judges whether or not the flag CF2 is ON (CF2=1).

If it is judged that CF2=1 (i.e., YES), the processing goes out from the routine in FIG. 2 as it is, and a procedure for judging the abnormality is continued.

Figure 3:
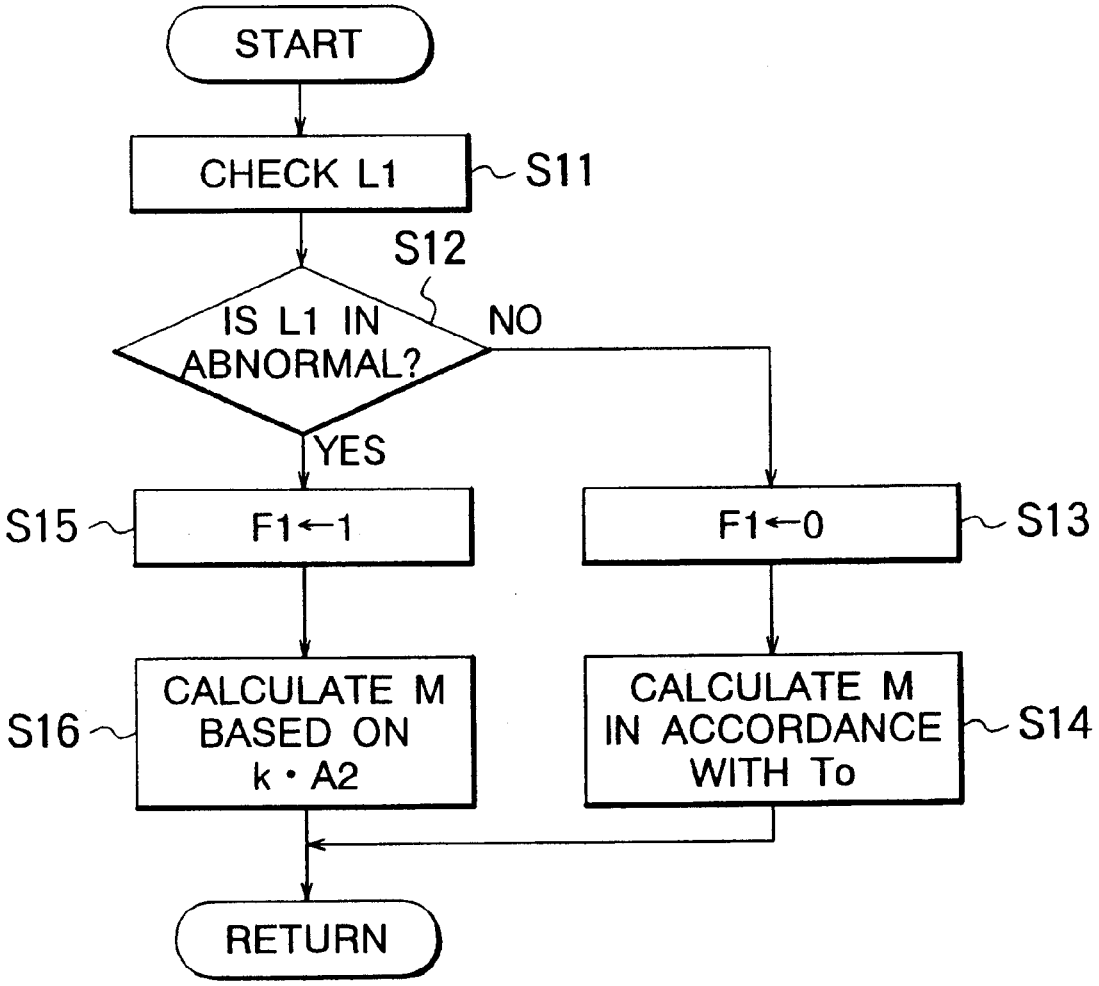
FIG. 3 is a flowchart showing an abnormality judging operation of a first communication line according to the first embodiment of the invention.
Figure 4:
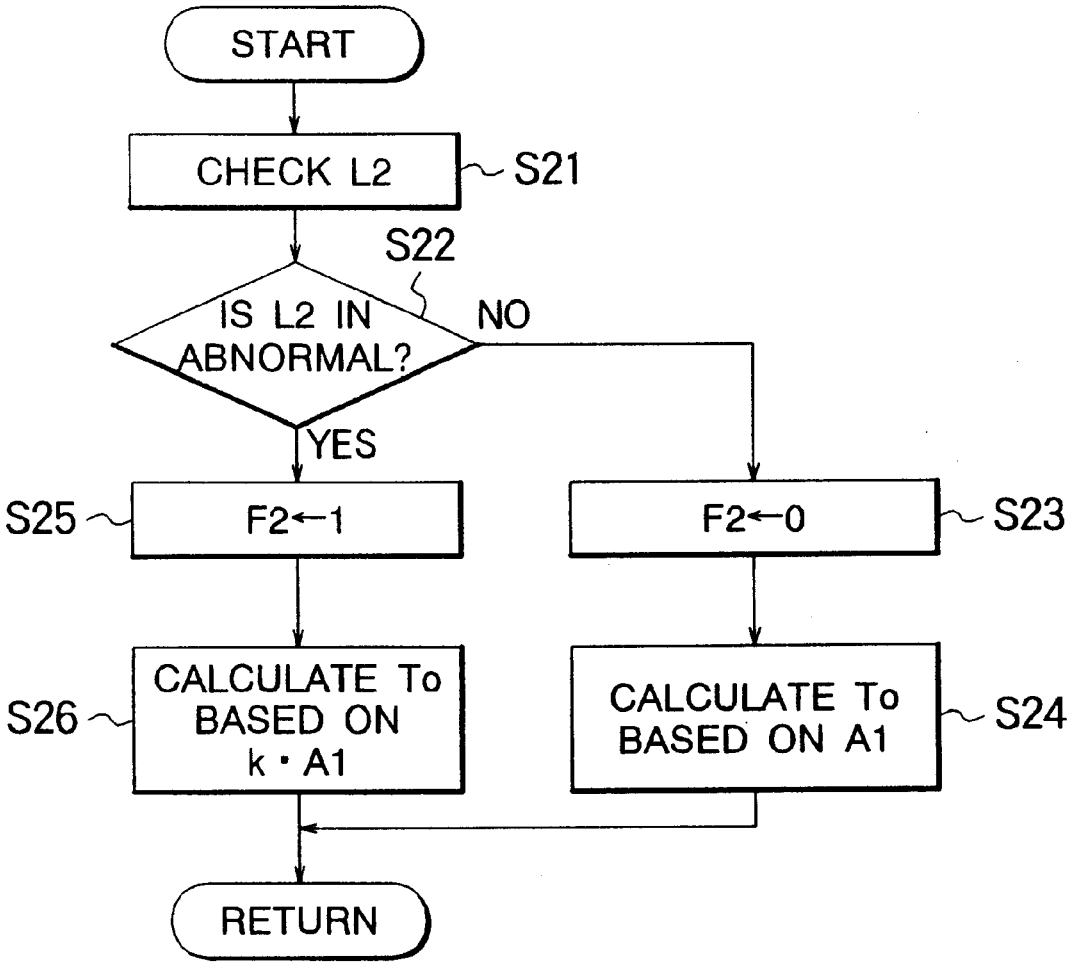
FIG. 4 is a flowchart showing an abnormality judging operation of a second communication line according to the first embodiment of the invention.

At the initial stage, if it is judged that CF2=0 (i.e., NO), the communication abnormality judging means in the control units 21 and 22 conduct the abnormality judging routines of the communication lines L1 and L2 shown in FIGS. 3 and 4, respectively. When the abnormality is judged, the flag F1 or F2 is turned ON (F1=1, F2=1) (step S2).

For example, in FIG. 3, the first communication abnormality judging means in the second control unit 22 checks an input data from the communication line L1 (step S11), and judges whether or not the communication line L1 is in abnormal (step S12).

If it is judged that the communication line L1 is not in abnormal (i.e., NO), the second control unit 22 clears the flag F1 to "0", (step S13), and calculates the motor driving signal M based on the target throttle opening degree To obtained from the first control unit 21 (step S14), and the processing goes out from the routine shown in FIG. 3.

On the other hand, if it is judged that the communication line L1 is in abnormal (i.e., YES) in step S12, the flag F1 indicative of abnormality of the communication line L1 is turned ON (F1=1) (step S15), the motor driving signal M is calculated based on the value obtained by multiplying the second accelerator opening degree signal A1 by the predetermined coefficient k (step S16), and the processing goes out from the routine shown in FIG. 3.

Further, in FIG. 4, the second communication abnormality judging means in the first control unit 21 checks an input data from the communication line L2 (step S21), and judges whether or not the communication line L2 is in abnormal (step S22).

If it is judged that the communication line L2 is not in abnormal (i.e., NO), the first control unit 21 clears the flag F2 to "0" (step S23), and calculates the target throttle opening degree To based on the first accelerator opening degree signal A1 (step S24), and the processing goes out from the routine shown in FIG. 4.

On the other hand, if it is judged that the communication line L2 is in abnormal (i.e., YES) in step S22, the flag F2 indicative of abnormality of the communication line L2 is turned ON (F2=1) (step S25), and calculates the target throttle opening degree To based on the value obtained by multiplying the first accelerator opening degree signal A1 by the predetermined coefficient k (step S26), and the processing goes out from the routine shown in FIG. 4.

The target throttle opening degree To calculated in step S24 or S36 is sent to the second control unit 22 though the communication line L1, and used for calculating the motor driving signal M.

If the abnormality judging routines of FIGS. 3 and 4 (step S2 in FIG. 2) are carried out in this manner, the second control unit monitoring means in the first control unit 21 judges, in FIG. 2, whether or not F1=1 or F2=1 (whether or not an abnormality is generated in the communication line L1 or L2) (step S3) by referring to flags F1 and F2.

If it is judged that there is no abnormality in each of the communication lines L1 and L2 and thus F1=0 and F2=0 (i.e., NO), the second control unit monitoring means does not carry out the monitoring process of the second control unit 22, and the processing goes out from the routine in FIG. 2.

Therefore, the flag CF2 remains 0 as it is, and the normal engine control and throttle control are continued by each of the control units 21 and 22.

On the other hand, if it is judged that the communication line L1 or L2 is in abnormal and thus F1=1 or F2=1 (i.e., YES) in step S3, the second control unit monitoring means subsequently judges whether or not the first communication line L1 is in abnormal (F1=1) in step S4, so as to carry out a processing in accordance with a type of the communication line in which the abnormality is generated.

If it is judged that the first communication line L1 is in abnormal and F1=1 (i.e., YES), the second control unit 22 is in a condition to control based on the first accelerator opening degree signal A1. Therefore, the second control unit monitoring means judges whether or not the second control unit 22 is in abnormal (step S5), depending upon whether or not a state which satisfies the following expression (1) continues for a predetermined time period, based on a comparison of the first throttle opening degree signal T1 with the first accelerator opening degree signal A1:

$$|kA2-T1|>E1 \quad (1)$$

wherein in the above expression (1), E1 is a predetermined value corresponding to an abnormality judging reference of the second control unit 22.

That is, the second control unit monitoring means judges whether a throttle control based on the second accelerator opening degree signal A2 by the second control unit 22 is carried out within a range of error of the throttle opening degree which is equal to or less than the predetermined value E1.

If the above-described expression (1) is not satisfied, or if the state which satisfies the expression (1) does not continues for the predetermined time period, it is judged that the second control unit 22 is not in abnormal (NO in step S5). Therefore, the processing goes out from the routine in FIG. 2, and a control state which suppresses the engine output continues.

Further, if it is judged that the state which satisfies the expression (1) continues for the predetermined time period and an abnormality is generated in the second control unit 22 (YES in step S5), the abnormality judging flag CF2 is turned ON (CF2=1) (step S6), and the throttle control state is switched to a temporary-driving mode (which is provided with necessary but minimum driving functions) (step S7), and the processing goes out from the routine shown in FIG. 2.

On the other hand, if it is judged that the second communication line L2 is in abnormal and F2=1 (i.e., NO) in step S4, the second control unit 22 is in a condition to control based on the target throttle opening degree To which is suppressed by the predetermined coefficient k. Therefore, the second control unit monitoring means judges whether or not the second control unit 22 is in abnormal (step S8), depending upon whether or not a state which satisfies the following expression (2) continues for a predetermined time period, based on a comparison of the first throttle opening degree signal T1 with the target throttle opening degree To:

$$|To-T1|>E2 \quad (2)$$

wherein in the above expression (2), E2 is a predetermined value corresponding to an abnormality judging reference of the second control unit 22, and may be the same value as the above-mentioned predetermined value E1.

If the above-described expression (2) is not satisfied, or if the state which satisfies the expression (2) does not continues for the predetermined time period, it is judged that the second control unit 22 is not in abnormal (NO in step S8). Therefore, the processing goes out from the routine in FIG. 2, and a control state which suppresses the engine output continues.

On the other hand, if it is judged that the state which satisfies the expression (2) continues for the predetermined time period and an abnormality is generated in the second control unit 22 (YES in step S8), the processing proceeds to the above-mentioned steps S6 and S7, the flag CF2 is turned ON, and the throttle control state is switched to a temporary-driving mode, and the processing goes out from the routine shown in FIG. 2.

Therefore, if the flag CF2 is once turned ON in steps S6 and S7, and the throttle control state is switched to a temporary-driving mode, such temporary-driving mode continues until the key switch is turned OFF.

More specifically, because there is almost no possibility that the abnormal condition of the second control unit 22 is automatically returned to normal condition, the temporary-driving mode (which is provided with necessary but minimum driving functions) is maintained until the vehicle reaches a service station and the key switch is turned OFF.

By substituting a mutual monitoring function between the control units 21 and 22 for abnormality monitoring functions of the communication lines L1 and L2 in this manner, it is possible to realize the abnormality judging function of the second control unit 22 with a simple logic, and to secure a reliable running property of the vehicle at low costs.

Further, when an abnormality is generated in the communication line L1 or L2, an abnormal operation of the second control unit 22 is monitored in the first control unit 21. Therefore, the abnormality judging logic is not complicated even in the control unit having a redundant structure, and it is possible to manufacture the control unit at low costs.

Second Embodiment

Although the temporary-driving mode when the abnormal operation of the second control unit 22 is judged is not concretely described in the first embodiment, a bypass passage for bypassing the throttle valve 6 and a bypass valve for adjusting a bypass drawn air amount flowing through the bypass passage may be provided as temporary-driving means.

Figure 5:
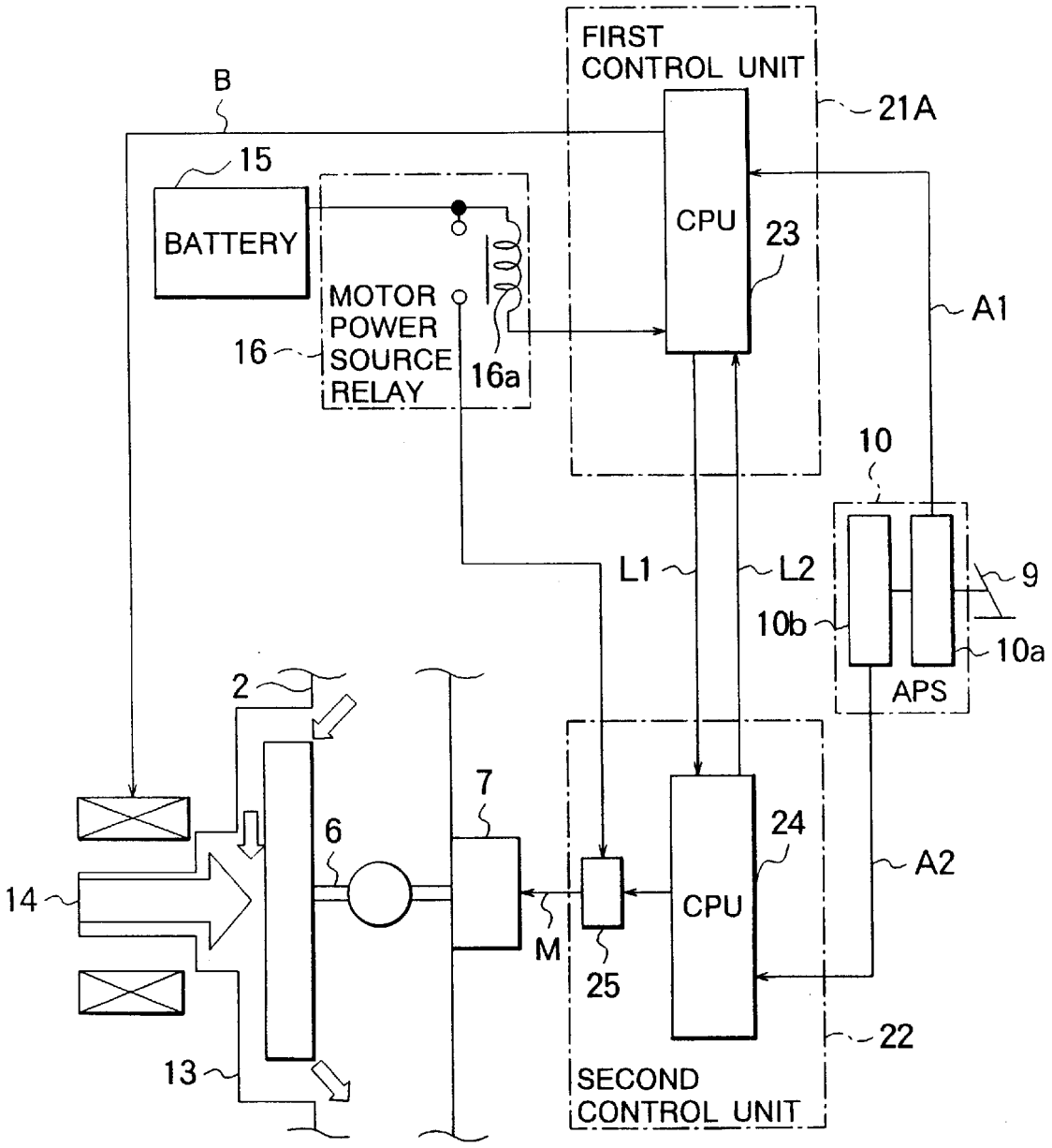
FIG. 5 is a block diagram showing a second embodiment of the invention.

FIG. 5 is a block diagram showing the second embodiment of the present invention in which the bypass valve is used as the temporary-driving means which executes the temporary-driving mode. Elements which are similar to those described above are designated with similar reference numbers, and their detailed explanations will be omitted.

A first control unit 21A corresponds to the above-described first control unit 21.

Structures which are not shown in FIG. 5 are the same as those shown in FIG. 1.

In the second embodiment, the first control unit 21A includes a CPU 23, and a second control unit 22 includes a CPU 24 and an inverter 25 for driving a throttle actuator 7 under the control of the CPU 24.

An intake pipe 2 is provided with a bypass passage 13 for bypassing a throttle valve 6, and a bypass valve 14 for adjusting a bypass drawn air amount flowing through the bypass passage 13.

The bypass valve 14 is driven by a bypass valve control signal B from the CPU 23,the bypass pass area of a flow path of the bypass passage 13 to variably control the bypass drawn air amount.

An electric power is supplied from a battery 15 to the inverter 25 in the second control unit 22 through a motor power source relay 16.

The motor power source relay 16 constitutes a throttle power source cutting-off means for selectively cutting off an electric supply to the throttle actuator 7.

An exciting coil 16*a* in the motor power source relay 16 is connected at its one end to the battery 15, and is connected at its other end to the CPU 23, such that the exciting coil 16*a* is operated in response to the second control unit monitoring means.

More specifically, when the second control unit monitoring means in the CPU 23 judges an abnormality of the second control unit 22 to switch the engine (see FIG. 1) into the temporarydriving mode, the second control unit monitoring means first open the motor power source relay 16 to cut off the electric supply from the battery 15 into the inverter 25 in the second control unit 22.

When the electric supply to the throttle actuator 7 is cut off in this manner, the throttle valve 6 is returned to and fixed to its fully closed position as illustrated.

Simultaneously, the second control unit monitoring means in the CPU 23 calculates a control amount of the bypass valve 14, and outputs the result as a bypass valve control signal B.

As described above, when the communication line L1 or L2 is in abnormal, the engine output is suppressed for temporary driving, and when the second control unit 22 is in abnormal, the motor power source relay 16 is cut off and the throttle valve 6 is returned and fixed to and fixed to its fully closed position, and the bypass valve 14 is controlled for temporary driving. Therefore, a running property can be secured. Furthermore, because the engine 1 is driven by a bypass drawn air amount in accordance with the opening degree of the bypass valve 14, a safety temporary-driving mode is realized.

Third Embodiment

Although the bypass passage 13 and the bypass valve 14 are used in the above-described second embodiment, the throttle valve may be returned to and fixed to its intermediate position without fully closing the same at the time of temporary-driving mode.

Figure 6:
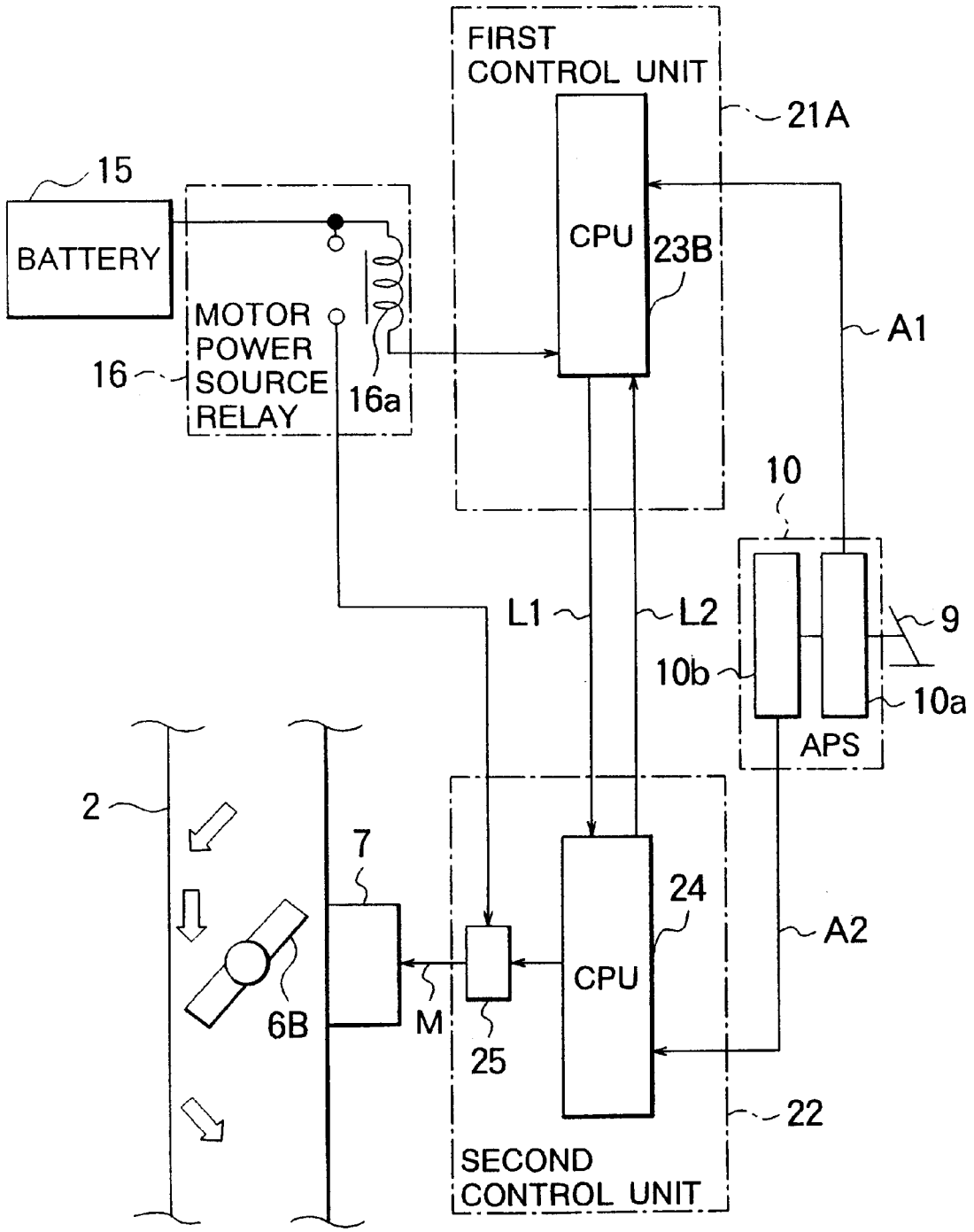
FIG. 6 is a block diagram showing a third embodiment of the invention.

FIG. 6 is a block diagram showing the third embodiment of the invention which uses, as the temporary driving means, means for returning and fixing the throttle opening degree to the intermediate position. Elements which are similar to those described above are designated with similar reference numbers, and their detailed explanations will be omitted.

A throttle valve 6B, a first control unit 21B and a CPU 23B correspond to the above-described throttle valve 6, the first control unit 21A and the CPU 23, respectively.

Figure 7:
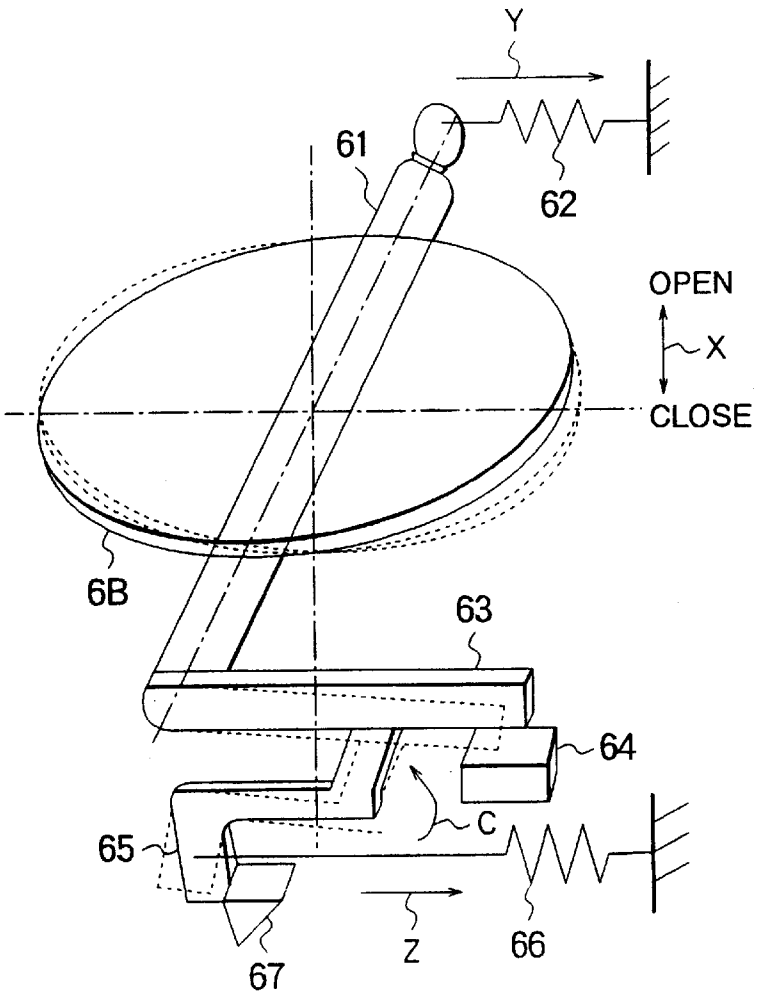
FIG. 7 is a perspective view showing an example of a specific structure of a throttle valve according to the third embodiment of the invention.
Figure 8:
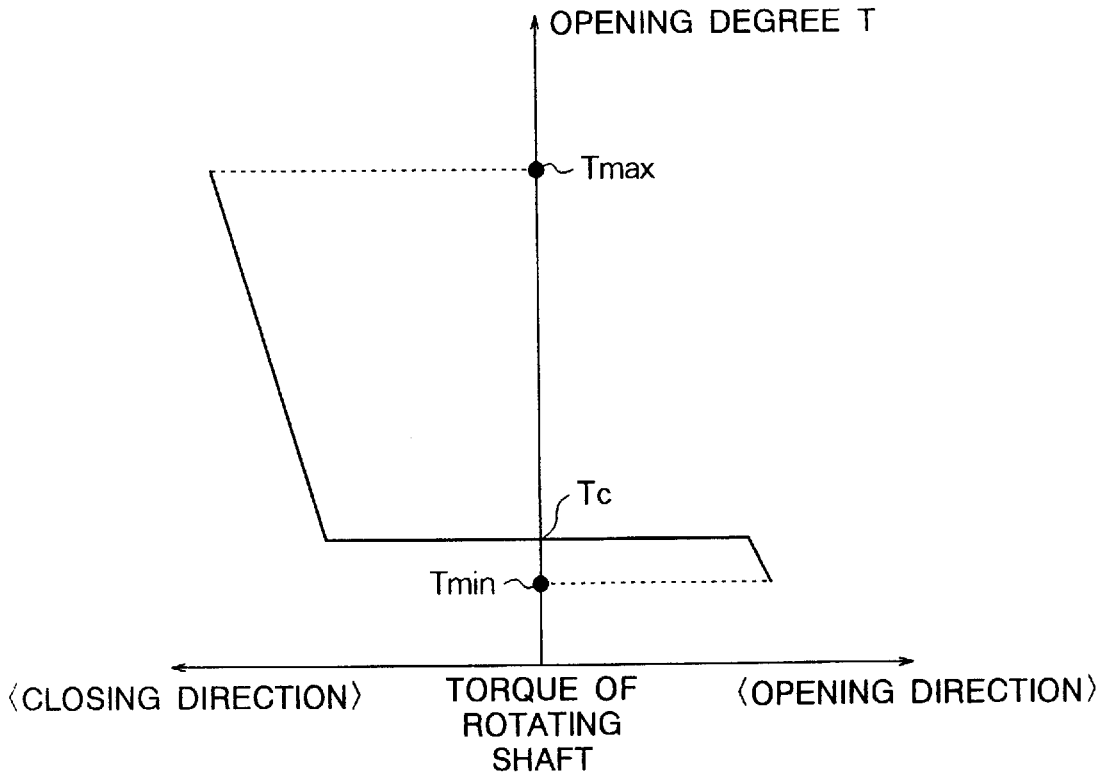
FIG. 8 is a view for explaining a variation of a throttle opening degree according to the third embodiment of the invention.
Figure 9:
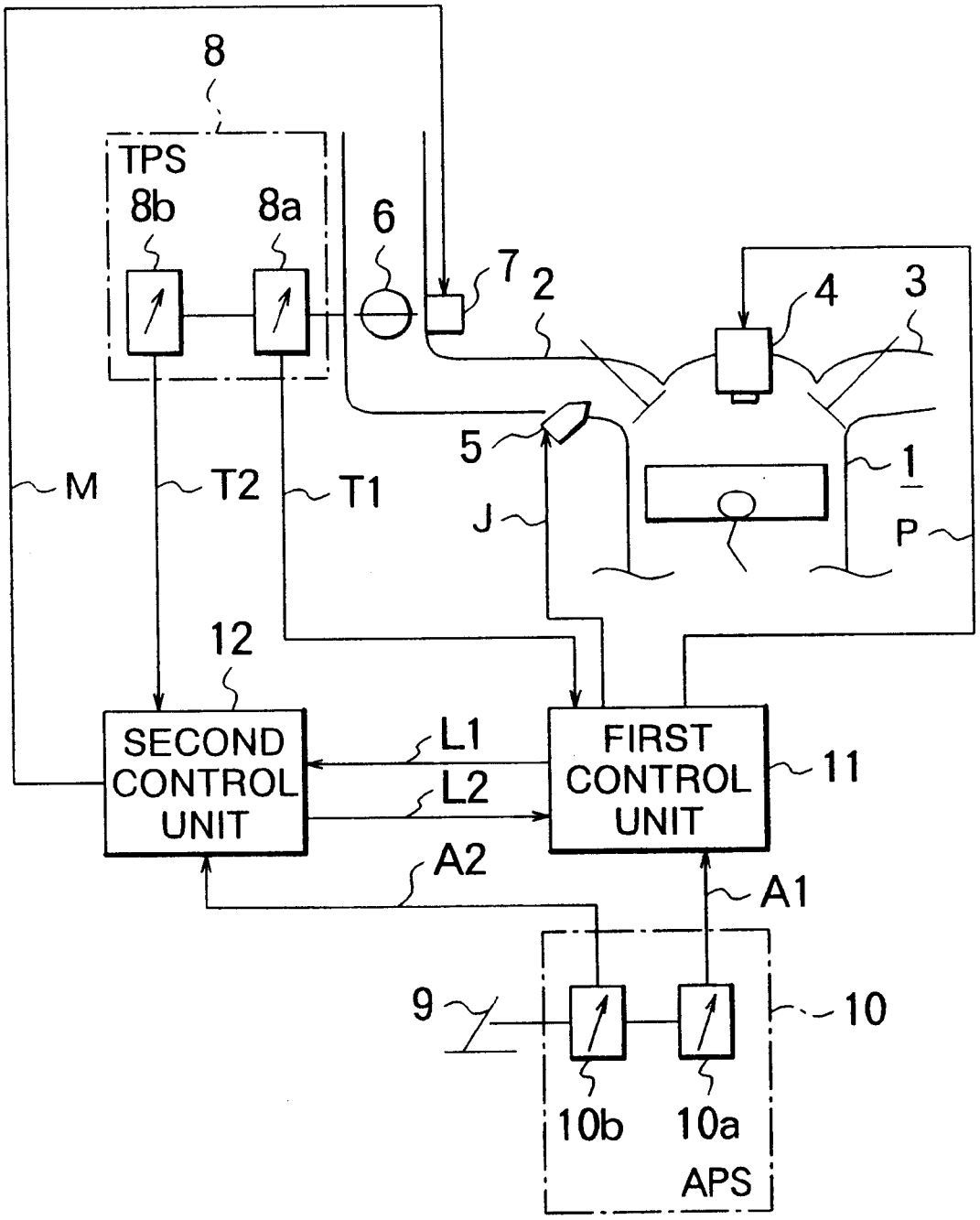
FIG. 9 PRIOR ART
FIG. 9 is a block diagram showing a conventional driving control apparatus for an engine of a vehicle.

FIG. 7 is a perspective view showing a concrete example of a structure of the throttle valve 6B in FIG. 6, and FIG. 8 is a view for explaining a variation of the throttle opening degree T by the throttle valve 6B.

The throttle valve 6B is designed such that it stops at its intermediate opening degree which is slightly opened from its fully closed state when the electric supply to the throttle actuator 7 is cut of as shown in FIG. 7, for example.

In FIG. 7, a solid line shows the intermediate opening degree stopping position of the throttle valve 6B, and a broken line shows the fully closed position of the throttle valve 6B.

The throttle valve 6B is normally driven for opening and closing in the direction of arrow X around a rotating shaft 6*a* by a motor of the throttle actuator 7.

One end of the rotating shaft 61 is biased in the direction of arrow Y (a closing direction of the throttle valve 6B) by a return spring 62.

The rotating shaft 61 is provided at its other end with a lever portion 63 which project in a radial direction of the rotating shaft 61. A tip end of the lever portion 63 is designed to abut against a fully closing stopper 64 when the throttle valve 6B is fully closed.

The lever portion 63 is biased in the direction of arrow C (an opening direction of the throttle valve 6B) by one end of an intermediate lever 65.

The other end of the intermediate lever 65 is biased in the direction of arrow Z by an intermediate opening degree stopping spring 66 so as to apply a biasing force in the direction of arrow C in the one end of the intermediate lever 65.

The intermediate lever 65 is designed to abut against an intermediate opening degree stopper 67 so as to set the intermediate opening degree.

Due to a structure shown in FIG. 7, the throttle valve 6B is normally controlled in a range of opening degree from a fully closed position Tmin to a fully opened position Tmax by a driving force of the throttle actuator 7 as shown in FIG. 8.

In FIG. 8, the axis of abscissae indicates a throttle opening degree T, and the axis of ordinates indicates a torque of the rotating shaft 61. In FIG. 8, the upward direction indicates a throttle opening torque, and the downward direction indicates a throttle closing torque.

Therefore, when the second control unit 22 is in abnormal (at the time of temporary-driving mode), because of the biasing forces of the return spring 62 and the intermediate opening degree stopping spring 66 as well as a position of the intermediate opening degree stopper 67, the throttle valve 6B is returned to and fixed to the intermediate opening degree Tc when the electric power is cut off.

That is, when the engine 1 is in the temporary-driving mode, the throttle valve 6B is fixed to an intermediate position which is biased toward the opening direction from the fully closed position.

As described above, when the communication line L1 or L2 is in abnormal, the engine output is suppressed for temporary driving, and when the second control unit 22 is in abnormal, the motor power source relay 16 is cut off and the throttle valve 6B is returned to the intermediate opening degree for temporary driving. Therefore, a running property can be secured.

What is claimed is:

1. A driving control apparatus for an engine of a vehicle, comprising:

an engine mounted in a vehicle;

a throttle valve for adjusting an air amount to be drawn into said engine;

a throttle actuator including a motor for driving said throttle valve;

an accelerator position sensor for detecting a position of an accelerator pedal as an accelerator opening degree;

a throttle position sensor for detecting a position of said throttle valve as a throttle opening degree;

a first control unit for calculating a control parameter with respect to said engine in accordance with a driving state including said accelerator opening degree and said throttle opening degree;

a second control unit for calculating a control amount of said throttle actuator in accordance with a target throttle opening degree which is included in said control parameter;

a first communication line for transmitting data from said first control unit to said second control unit; and a second communication line for transmitting data from said second control unit to said first control unit; wherein said accelerator position sensor includes first and second accelerator position sensor portions for respectively outputting first and second accelerator opening degree signals which are redundant with each other;

said throttle position sensor includes first and second throttle position sensor portions for respectively outputting first and second throttle opening degree signals which are redundant with each other;

said first accelerator opening degree signal and said first throttle opening degree signal are input to said first control unit;

said second accelerator opening degree signal and said second throttle opening degree signal are input to said second control unit;

said second control unit includes first communication abnormality judging means for judging an abnormality of said first communication line;

the result of judgement of the abnormality of said first communication line is sent to said first control unit through said second communication line; and said first control unit includes:

second communication abnormality judging means for judging an abnormality of said second communication line; and second control unit monitoring means for monitoring an operation of said second control unit based on at least said first throttle opening degree signal when an abnormality is judged in said first or second communication line.

2. A driving control apparatus for an engine of a vehicle according to claim 1, wherein when an abnormality of said first communication line is judged, said second control unit calculates the control amount of said throttle actuator based on said second accelerator opening degree signal.

3. A driving control apparatus for an engine of a vehicle according to claim 2, wherein when an abnormality of said first communication line is judged, said second control unit calculates the control amount of said throttle actuator based on a value obtained by suppressing said second accelerator opening degree by a predetermined coefficient.

4. A driving control apparatus for an engine of a vehicle according to claim 1, wherein when an abnormality of said second communication line is judged, said first control unit calculates said target throttle opening degree based on a value obtained by suppressing said first accelerator opening degree signal by a predetermined coefficient, and sends said target throttle opening degree to said second control unit through said first communication line.

5. A driving control apparatus for an engine of a vehicle according to claim 2, wherein when an abnormality of said first communication line is judged, said second control unit monitoring means monitors an operation of said second control unit based on a comparison of said first throttle opening degree signal with said first accelerator opening degree signal.

6. A driving control apparatus for an engine of a vehicle according to claim 3, wherein when an abnormality of said first communication line is judged, said second control unit monitoring means compares said first throttle opening degree signal with a value obtained by multiplying said first accelerator opening degree signal by said predetermined coefficient; and when a state in which a difference between said first throttle opening degree signal and said value obtained by multiplying said first accelerator opening degree signal by said predetermined coefficient is equal to or greater than a predetermined value continues for a predetermined time period, said second control unit monitoring means judges an abnormality in operation of said second control unit.

7. A driving control apparatus for an engine of a vehicle according to claim 4, wherein when an abnormality of said second communication line is judged, said second control unit monitoring means monitors an operation of said second control unit based on comparison of said first throttle opening degree signal with said target throttle opening degree.

8. A driving control apparatus for an engine of a vehicle according to claim 7, wherein when an abnormality of said second communication line, said second control unit monitoring means judges an abnormality in operation of said second control unit, if a state in which a difference between said first throttle opening degree signal and said target throttle opening degree is equal to or greater than a predetermined value continues for a predetermined time period.

9. A driving control apparatus for an engine of a vehicle according to claim 1, further including throttle electric power source cutting-off means; wherein when an abnormality in operation of said second control unit is judged, said throttle electric power source cutting-off means cuts off a supply of electric power source to said throttle actuator, and a driving state of said engine is switched to a temporary-driving mode.

10. A driving control apparatus for an engine of a vehicle according to claim 9, further including a bypass passage for bypassing said throttle valve; and a bypass valve for adjusting a bypass drawn air amount flowing through said bypass passage; wherein at the time of the temporary-driving mode of said engine, said throttle valve is fully closed by cutting off the supply of electric power source to said throttle actuator, and said first control unit calculates a control amount of said bypass valve.

11. A driving control apparatus for an engine of a vehicle according to claim 9, wherein at the time of the temporary-driving mode of said engine, said throttle valve is fixed to an intermediate position which is biased toward its opening direction from its fully closed position.

12. A driving control apparatus for an engine of a vehicle according to claim 9, wherein the temporary-driving mode of said engine is maintained until a key switch of said vehicle is turned OFF.

* * * * *